US006152750A

United States Patent [19]

Huguenet et al.

[11] Patent Number: 6,152,750

[45] Date of Patent: Nov. 28, 2000

[54] ELECTRICAL CONNECTION DEVICE WITH A SWITCH

[75] Inventors: Jean-Pierre Huguenet, Biarne; Philippe Bertrand, Dole, both of France

[73] Assignee: Amphenol Socapex, France

[21] Appl. No.: 09/304,064

[22] Filed: May 4, 1999

[30] Foreign Application Priority Data

May 7, 1998 [FR] France ..... 98 05793

[51] Int. Cl.[7] ..... H01R 29/00

[52] U.S. Cl. ..... 439/188; 200/51.1; 439/916

[58] Field of Search ..... 439/188, 916; 200/51.1

[56] References Cited

U.S. PATENT DOCUMENTS 4,286,335 8/1981 Eichler et al. ..... 439/916
5,584,713 12/1996 Kato et al. ..... 439/188
5,839,910 11/1998 Meller et al. ..... 439/188
5,882,217 3/1999 Aponte et al. ..... 439/188
5,989,046 11/1999 Togashi ..... 439/188

FOREIGN PATENT DOCUMENTS 0 601 702 6/1994 European Pat. Off. ..... H01R 13/71
95/30258 11/1995 WIPO ..... H01R 13/648

*Primary Examiner*—T. C. Patel
*Attorney, Agent, or Firm*—Blank Rome Comisky & McCauley, LLP

[57] ABSTRACT

The invention relates to a connection device having a switch which is particularly, but not exclusively, suited or use in making a connection between a portable appliance having an antenna, such as a radiotelephone, and a connection device, such as a device mounted in a motor vehicle and connected to the antenna of the motor vehicle.

6 Claims, 4 Drawing Sheets

ELECTRICAL CONNECTION DEVICE WITH A SWITCH

FIELD OF THE INVENTION

The present invention relates to an electrical connection device with a switch.

More precisely, the invention relates to an electrical connection device which also serves to perform an electrical switching function and which is particularly, but not exclusively suitable for use in making an optional connection between a portable appliance having an antenna, e.g. a radiotelephone, and a connection element, e.g. mounted in a motor vehicle and connected to an antenna of the motor vehicle.

BACKGROUND OF THE INVENTION

The very large expansion of radiotelephones is well known, and those radiotelephones are naturally fitted with their own antennas and they are powered by batteries, optionally rechargeable batteries.

When the user of a radiotelephone is in a motor vehicle, it is advantageous to be able to connect the radiotelephone to the circuits of the motor vehicle, and mainly to an antenna of the vehicle so as to provide better quality of both-way transmission between the radiotelephone and the outside.

For this purpose, the radiotelephone is fitted with a connection element comprising a base, and the motor vehicle is fitted with a connection element comprising a plug which is connected to the antenna of the vehicle. It will be understood that when the radiotelephone is used in independent manner, it is necessary for the radiotelephone's own antenna to be connected to the processor circuits of the radiotelephone, and that when the radiotelephone is connected to the motor vehicle antenna, it is necessary for the link with the radiotelephone's own antenna to be interrupted and for a link to be established between the processor circuits internal to the radiotelephone and the antenna of the motor vehicle.

In order to optimize operation of the radiotelephone when connected to the motor vehicle antenna, it is also desirable for the radiotelephone's own antenna to be connected to radiotelephone ground.

Nevertheless, a connection device with built-in switching can also be used in contexts other than that described above, insofar as a connection is to be made either between a coaxial cable and the circuits of a portable appliance, or a connection is to be made between the same processing circuits of the portable appliance and an antenna belonging thereto.

OBJECTS AND SUMMARY OF THE INVENTION

An object of the present invention is to provide an electrical connection device with a switch that is constituted by a base and a plug making it possible, when the base of the appliance is connected to an external plug, to switch between a link internal to an appliance to which the base is connected and a link which is external thereto.

According to the invention, this object is achieved by a connection device having a switch, the device comprising a base designed to be mounted on a portable appliance fitted with a first antenna and a plug designed in particular to be connected to a second antenna, the base being suitable for being connected to the plug, wherein the base comprises:

an axial conductor designed to be connected to a circuit of the portable appliance;

a first cylindrical conductor substantially coaxial about the axial conductor, insulated from the axial conductor, and designed in particular to be connected to the first antenna;

a second cylindrical conductor surrounding the first cylindrical conductor and insulated therefrom, the second cylindrical conductor being designed in particular to be connected to the ground of the portable appliance; and a resilient electrical switch member that is circularly symmetrical about the axis common to the cylindrical conductors, having a first end secured to one of the two elements constituted by the first cylindrical conductor and the axial conductor, and having its second end when at rest in contact with the other one of the two elements; and wherein the plug comprises:

a hollow axial first conductor suitable for co-operating with the axial conductor of the base, the hollow conductor being designed in particular for connection to the second antenna;

a cylindrical second conductor surrounding the hollow conductor substantially coaxially, and designed in particular to be connected to the shielding of the second antenna; and mechanical insulating means for holding the second end of the switch member away from its rest position when the plug is engaged in the base, whereby, when the plug is engaged in the base, the hollow conductor of the plug comes into resilient contact with the axial conductor of the base and the mechanical insulating means hold off the second end of the switch member, and the cylindrical second conductor of the plug comes into electrical contact with at least the second cylindrical conductor of the base.

It will be understood that by means of the dispositions of the invention, when the base is not connected to the plug, the position of the switch member is such that the axial conductor is connected to the first cylindrical conductor of the base, thereby providing the link between the antenna conductor of the portable appliance and the processing circuits of the appliance when the connection device is used with an appliance having an antenna. However, when the plug is engaged in the base, the switch member is moved away and the device which is connected to the plug, in particular the antenna of the motor vehicle, is connected to the circuit of the portable appliance while the antenna shielding is connected to ground of the portable appliance.

Furthermore, because of the circularly symmetrical shape of the switch element, very good electrical conduction is obtained when the switch element is at rest.

Preferably, in the device, the first end of the switch member is secured to the first cylindrical conductor and its second end at rest is in contact with said axial conductor, and said insulating mechanical means comprise an insulating sleeve surrounding said hollow axial first conductor.

In a preferred embodiment, the free end of said cylindrical second conductor of the plug is shaped, so that when the plug is in engaged in the base, it enters into electrical contact simultaneously with the said first and second cylindrical conductors of the base.

It will be understood that using this improved embodiment of the connection device having a switch, a link is made between the first cylindrical conductor connected to portable appliance ground and the second cylindrical conductor which is connected to the shielding of the external antenna.

BRIEF DESCRIPTION OF THE DRAWINGS

Other characteristics and advantages of the invention will appear more clearly on reading the following description of an embodiment of the invention given by way of non-limiting example. The description refers to the accompanying figures, in which.

MORE DETAILED DESCRIPTION

Figure 1:
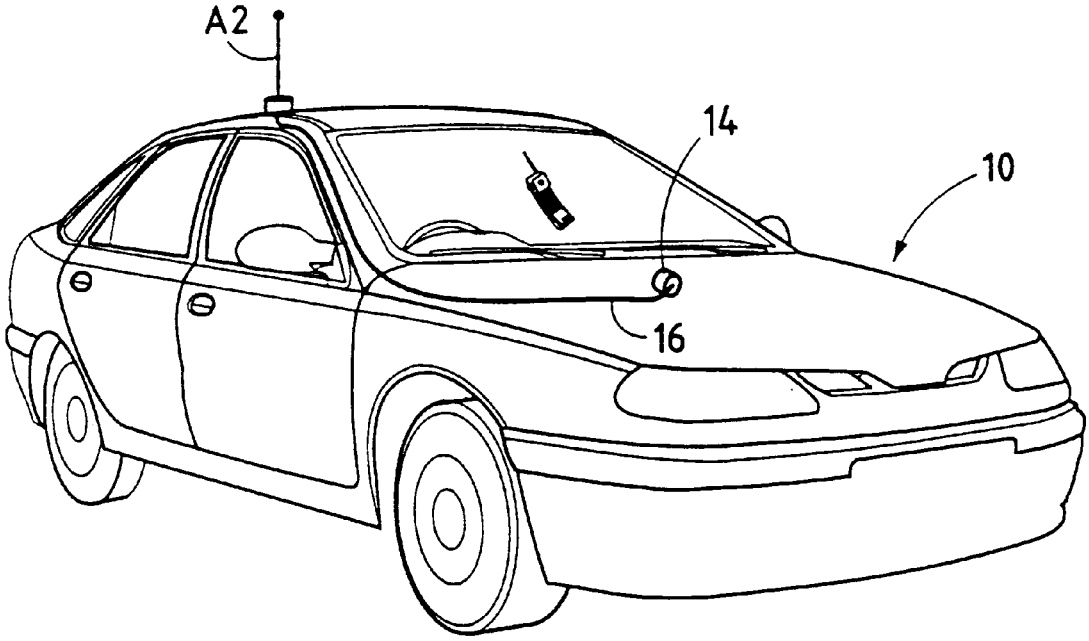
FIG. 1 is an overall view of an embodiment of the invention applied to the case of a radiotelephone and a motor vehicle antenna.
Figure 1:
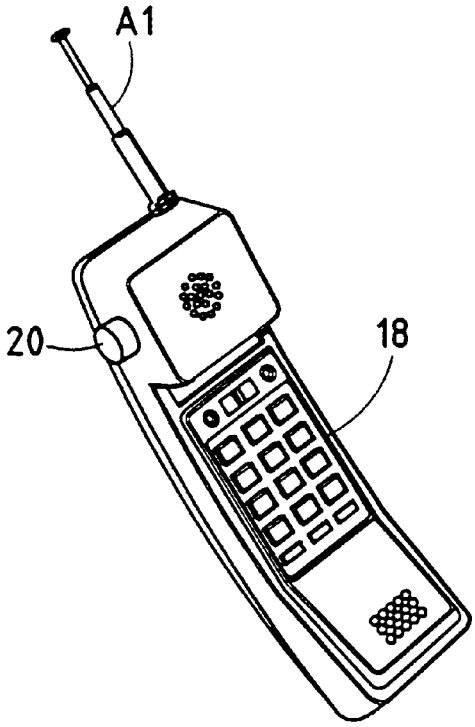

FIG. 1 shows in highly diagrammatic manner a motor vehicle 10 fitted with its own antenna A2 connected to a fixed plug 14 by an antenna conductor 16. The same figure also shows in diagrammatic manner a radiotelephone 18 fitted with its own antenna A1. In the Figure, there are also shown diagrammatically a base 20 designed to be connected to the plug 14 of the motor vehicle when the radiotelephone 18 is to be used therein.

Figure 2:
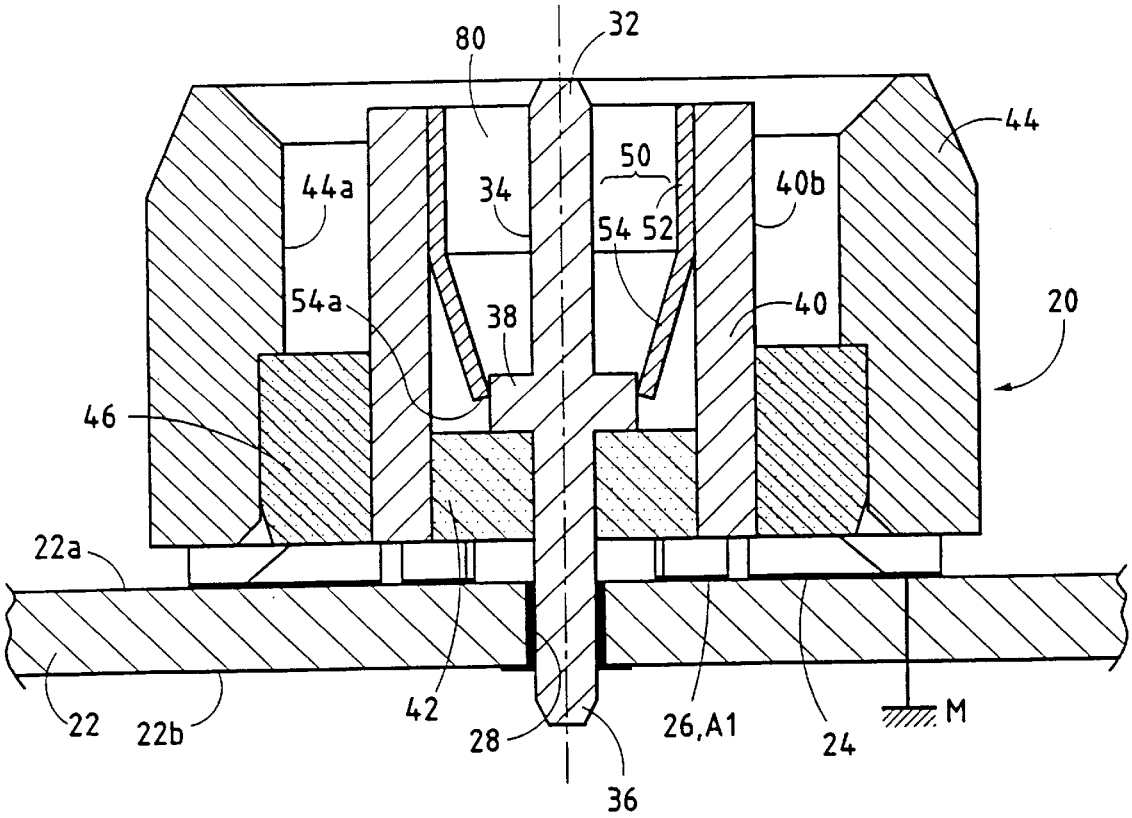
FIG. 2 is a vertical section view through the base of the connection device.

With reference initially to FIG. 2, there follows a description of a preferred first embodiment of the base of a connection device having a switch. In the figure, there can be seen the printed circuit 22 of the portable appliance, e.g. the radiotelephone 18 as shown in FIG. 1. On its top face 22*a,* the printed circuit 22 has various areas of metallization and conductive tracks, and in particular a first track 24 which is connected to ground M of the portable appliance, a second track 26 which is electrically connected to the portable appliance's own antenna A1, and a plated-through hole 28 connected to a conductive track 30 made on the bottom face 22*b* of the printed circuit. The conductive track 30 is electrically connected to the processing circuits of the portable appliance, e.g. of the radiotelephone, so as to enable the radiotelephone to perform its transmit and receive functions.

The base proper 20 is constituted by an axial conductor 32 which has a cylindrical external portion 34, a cylindrical bottom portion 36 which is engaged in the plated-through hole 28, and a middle portion 38 having an outside diameter that is greater than that of the remainder of the axial conductor 32. Around the axial conductor 32 there is a first cylindrical conductor 40 that is coaxial about the axial conductor 32. An insulating ring 42 connects the first cylindrical conductor 40 mechanically to the axial conductor 32. The first cylindrical conductor 40 is electrically connected to the conductive track 26 which is itself connected to the antenna A1.

The base 20 also has a second cylindrical conductor 44 which is substantially coaxial about the axial conductor 32 and which surrounds the first cylindrical conductor 40. The second cylindrical conductor 44 is mechanically connected to the first cylindrical conductor 40 via a second insulating ring 46. In the embodiment shown, the outer cylindrical conductor 44 is electrically connected to the conductive track 24, i.e. to the ground M of the portable appliance, e.g. of the radiotelephone.

As shown in FIG. 2, the first cylindrical connection conductor 40 is fitted with a switch member 50 comprising a first cylindrical portion 52 secured to the inside face of the cylindrical conductor 40 so as to provided electrical continuity between these two parts. The switch element 50 also has an elastically deformable portion of generally frustoconical shape and provided with slots to enable it to deform elastically, as explained below. At rest, the frustoconical portion 54 of the switch member 50 is in contact with the larger diameter portion 38 of the axial conductor 32. It will be understood that in this position an electrical link is thus established between the first cylindrical conductor 40 and the axial conductor 32. In other words, in the embodiment shown, this establishes an electrical connection between the conductive track 26 and the conductive track 30, i.e. a link between the antenna A1 of the radiotelephone and the processing circuits thereof.

Furthermore, because of the circularly cylindrical shape of the switch member 50, electrical conduction between the cylindrical conductor 40 and the axial conductor 32 is of very good quality.

In the above-described embodiment, the printed circuit 22 is a double-sided circuit. It would not go beyond the invention to use a single-sided printed circuit in which all of the metallization is provided on its top face 22*a*. That would require additional metallization to be made for the axial conductor 32 but it would avoid having a plated-through hole 28.

Figure 3:
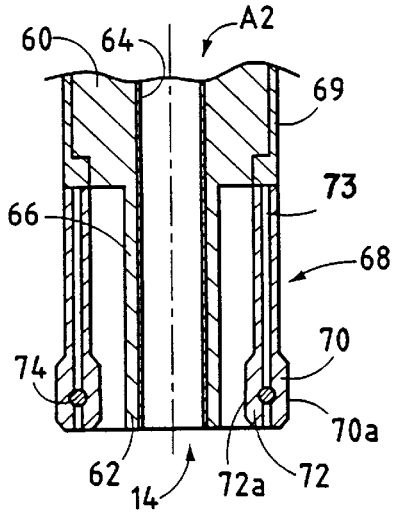
FIG. 3 is an axial section view through the plug of the connection device having a switch.

With reference now to FIG. 3, there is described a preferred embodiment of the fixed plug of the connection device having a switch.

This plug comprises an insulating body 60 having an axial bore 62 for receiving the antenna conductor and its female contact 64. The insulating body 60 is terminated by an insulating sleeve 66 which surrounds the contact 64. The plug 14 also has an outer connection element 68 which is electrically connected via 69 to the shielding of the antenna A2. In a preferred embodiment, the outer connection element 68 of the plug 14 is made from two concentric ferrules of conductive material respectively referenced 70 and 72. A gap 73 is left between the conductive ferrules 70 and 72. The ferrules 70 and 72 have free edges 70*a* and 72*a* of increased thickness and a conductive ring 74 is interposed between the free edges 70*a* and 72*a* of the two ferrules constituting the outer conductor 68 of the plug. This provides a cylindrical outer conductor 68 whose end is deformable to some extent.

It will be understood that when it is desired to connect the portable appliance fitted with the base 20 to the external antenna A2 connected to the plug 14, the base 20 is engaged on the plug 14 so that the insulating sleeve 66 of the plug penetrates into the annular gap 80 disposed between the axial conductor 32 and the first cylindrical conductor 40 and so that the free edge 70*a,* 72*a* of the outer conductor 68 penetrates into the annular gap 82 extending between the cylindrical conductors 40 and 44.

When the plug 14 is pushed into the base 20, the insulating sleeve 66 acts on the elastically deformable portion 54 of the switch member 50, thereby moving its free edge 54*a* away from the portion 38 of the axial conductor 32. This interrupts the electrical link between the axial conductor 32 and the first cylindrical conductor 40. Simultaneously, electrical contact is established between the central conductor 64 of the plug and the axial conductor 32. In addition, when the plug 14 is inserted into the base 20, the free edges 70*a* and 72*a* of the ferrules constituting the outer conductor of the plug 14 come into contact respectively with the inner face 44*a* of the outer cylindrical conductor 44, and with the outer face 40*b* of the inner cylindrical conductor 40. These two electrical contacts provide an electrical link between the conductive track 26 and the conductive track 24. This serves to ground the antenna A1 of the portable appliance on which the base 20 is fitted.

Figure 4:
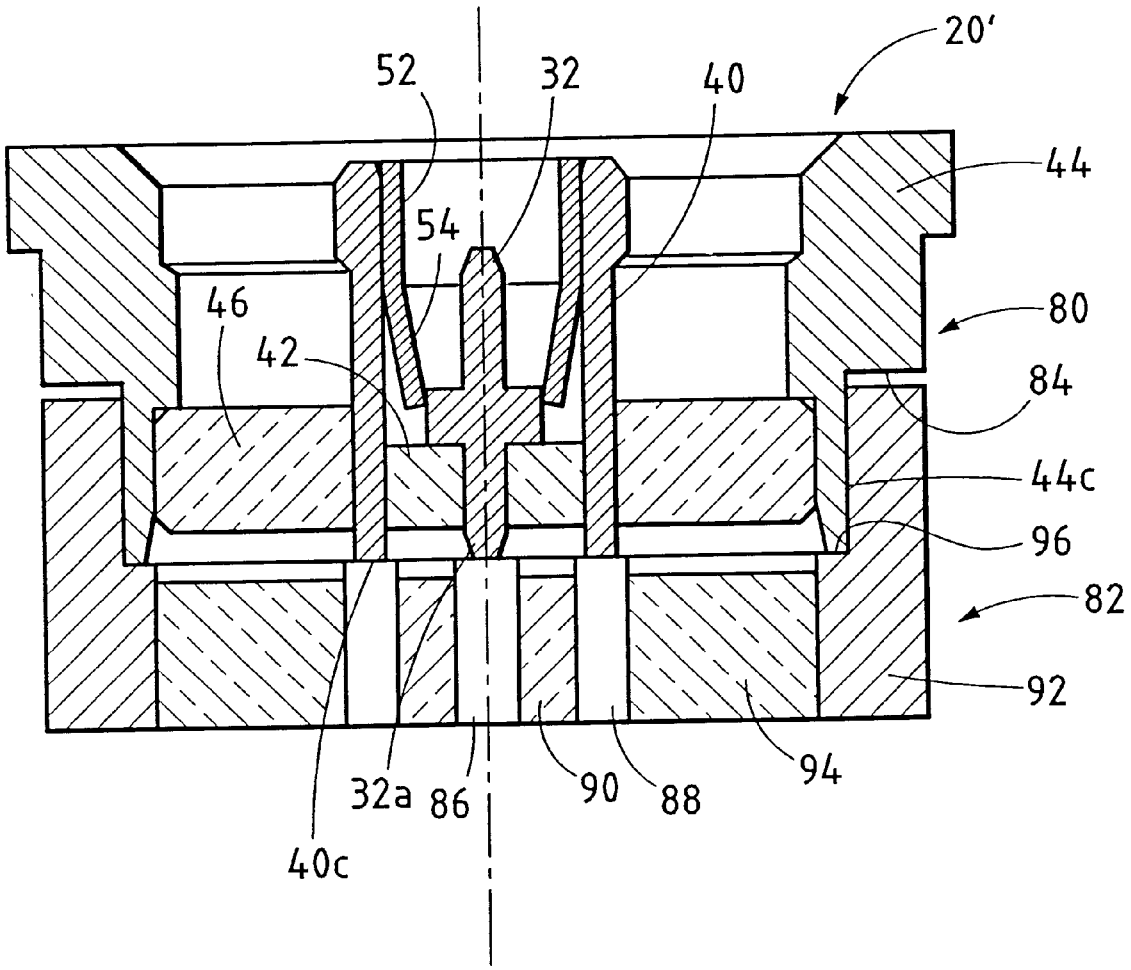
FIG. 4 shows a variant embodiment of the base.

FIG. 4 shows a variant embodiment of the base which is given reference 20'. The base 20' is constituted by a connection portion 80 which is a force-fit in a support portion 82.

The connection portion 80 has the same structure as in FIG. 2 with the exception of the bottom portions 32*a*, 40*c* and 44*c* respectively of the axial conductor 32 of the first cylindrical conductor 40 and of the second cylindrical conductor 44. More precisely, the bottom ends 32*a* and 40*c* project beneath insulating rings 42 and 46, and the bottom end 44*c* is of reduced thickness so as to form a shoulder 84.

The support portion 82 comprises an axial conductor 86, a first electrical conductor 88 secured to the axial conductor by a first insulating ring 90, and a second cylindrical conductor 92 secured to the first cylindrical conductor 88 via a second insulating ring 94. The second cylindrical conductor 92 projects beneath the insulating ring 94 and has a shoulder 96 corresponding to the shoulder 84 of the connection portion 80 so as to form a tight fit. When the connection portion 80 is engaged in the support portion 82, respective electrical connections are established between the axial conductors 32 and 86, between the first cylindrical conductors 40 and 88, and between the second cylindrical conductors 44 and 92.

The conductor elements 86, 88, and 92 are preferably made of electrically conductive elastomer and the insulating rings 90 and 94 are also made of elastomer. This makes t possible for the assembly to move axially when the plug is pushed in, thereby protecting the printed circuit proper. Under such circumstances, the printed circuit is single-sided.

Figure 5:
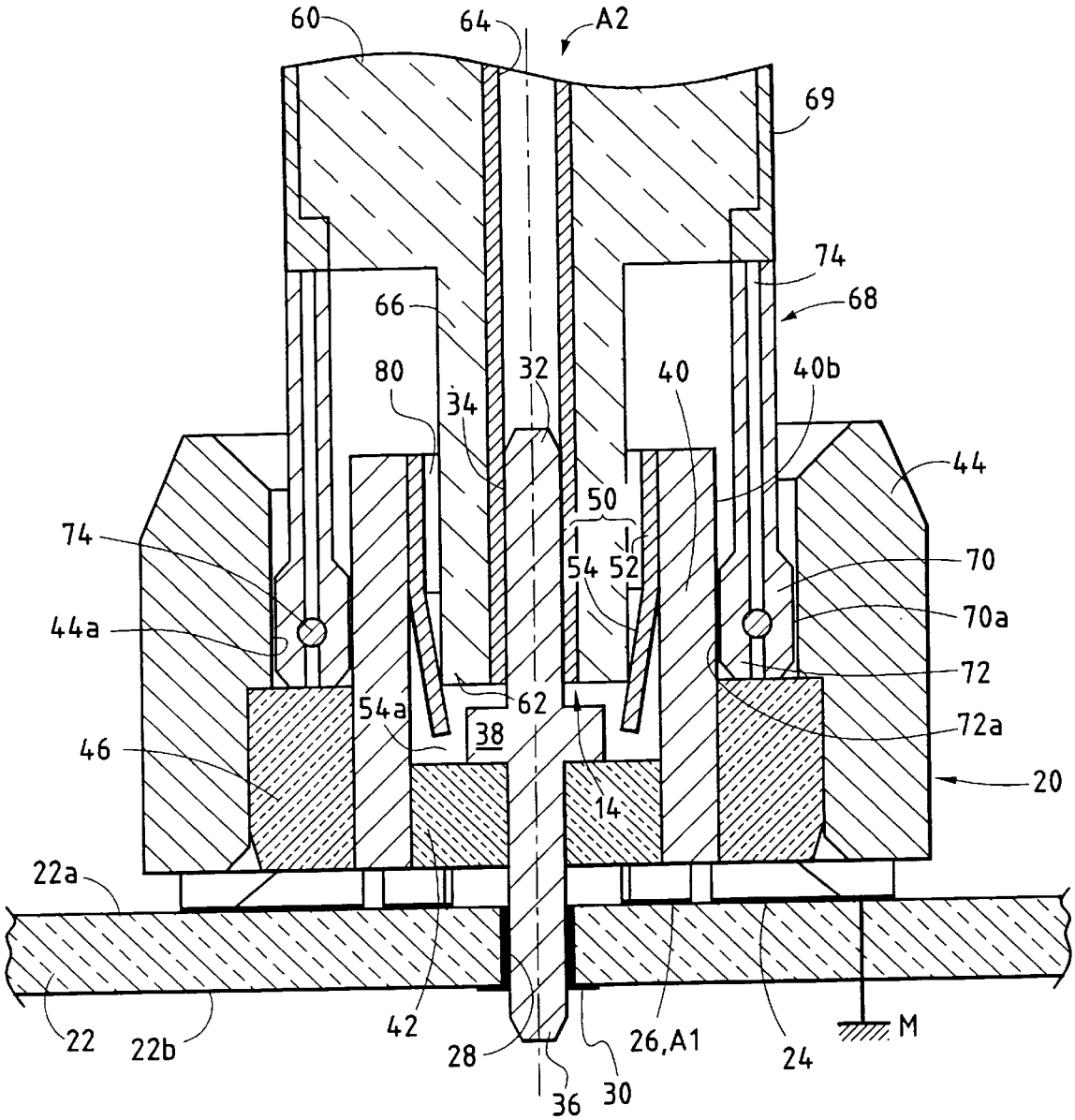
FIG. 5 is a sectional view of the plug depicted in FIG. 3 inserted in the base depicted in FIG. 2.

FIG. 5 shows the plug 14 depicted in FIG. 3 inserted into the base 20 depicted in FIG. 2. The same numeral references and description of FIGS. 2 and 3 apply to FIG. 5.

What is claimed is:

1. A connection device having a switch, the device comprising a base mountable on a portable appliance fitted with a first antenna and a plug adapted to be connected to a second antenna, said base being suitable for being connected to said plug, wherein said base comprises:

an axial conductor adapted to be connected to a circuit of said portable appliance;

a first cylindrical conductor substantially coaxial about said axial conductor, insulated from said axial conductor, and adapted to be connected to said first antenna;

a second cylindrical conductor surrounding said first cylindrical conductor and insulated therefrom, said second cylindrical conductor being adapted to be connected to a ground connection of said portable appliance; and a resilient electrical switch member that is circularly symmetrical about the axis common to the cylindrical conductors, having a first end secured to one of two elements constituted by the first cylindrical conductor and the axial conductor, and having its second end when at rest in contact with the other one of said two elements;

and wherein said plug comprises:

a hollow axial first conductor suitable for cooperating with the axial conductor of the base, said hollow conductor being adapted for connection to said second antenna;

a cylindrical second conductor surrounding said hollow first conductor substantially coaxially, and adapted to be connected to the shielding of said second antenna; and mechanical insulating means for holding the second end of the switch member away from its rest position when said plug is engaged in said base, whereby, when said plug is engaged in said base, the hollow first conductor of the plug comes into resilient contact with the axial conductor of the base and the mechanical insulating means hold off the second end of the switch member, and said cylindrical second conductor of the plug comes into electrical contact with at least said second cylindrical conductor of the base.

2. A connection device according to claim 1, wherein the first end of the switch member of the base is secured to the first cylindrical conductor and its second end at rest is in contact with said axial conductor, and wherein said insulating mechanical means of the plug comprise an insulating sleeve surrounding said hollow axial first conductor.

3. A connection device having a switch according to claim 2, wherein the free end of said cylindrical second conductor of the plug is shaped, so that when the plug is engaged in the base, it simultaneously enters into electrical contact with the said first and second cylindrical conductors of the base.

4. A connection device according to claim 3, wherein said cylindrical second conductor of the plug is constituted by two coaxial cylindrical ferrules having a free edge, said ferrules being separated by a cylindrical slot, and by a conductive ring interposed between the two ferrules close to their free edge.

5. A connection device according to claim 2, wherein said switch member has a substantially cylindrical first portion secured to the inside face of the first cylindrical conductor of the base, and a deformable frustoconical portion whose free edge when at rest is in contact with said axial conductor of the base.

6. A connection device according to claim 5, wherein said axial conductor of the base comprises a first cylindrical portion suitable for co-operating with the hollow first conductor of the plug, and an enlarged portion with which the free edge of the frustoconical portion of the switch member is in contact, when it is at rest.

* * * * *